US005501322A

United States Patent [19]

Drebushenko

[11] Patent Number: 5,501,322

[45] Date of Patent: Mar. 26, 1996

[54] RECYCLABLE BOTTLE CARRIER

[76] Inventor: Tina Drebushenko, 5341 Overland Dr., Huntington Beach, Calif. 92649

[21] Appl. No.: 300,125

[22] Filed: Sep. 2, 1994

[51] Int. Cl.[6] ..... B65D 71/00

[52] U.S. Cl. ..... 206/151; 206/147; 294/87.2

[58] Field of Search ..... 206/139, 142, 206/145, 147, 150, 151, 160, 161, 199, 427, 446, 486; 211/71, 74, 76; 294/87.2, 87.28

[56] References Cited

U.S. PATENT DOCUMENTS

| | | | |
|---|---|---|---|
| 2,419,040 | 4/1947 | Stephanian | 211/74 |
| 2,949,204 | 8/1960 | Edwards | 294/87.2 |
| 3,003,805 | 10/1961 | Glazer | 206/147 |
| 3,350,131 | 10/1967 | Tanzer | 294/87.2 |
| 3,968,914 | 7/1976 | Goncalves | 294/87.2 |
| 4,022,363 | 5/1977 | Eliassen | 294/87.28 |
| 4,651,873 | 3/1987 | Stolcenberg et al. | 206/199 |
| 4,664,255 | 5/1987 | Griffith | 206/427 |
| 4,735,313 | 4/1988 | Schoenberg | 206/427 |
| 4,798,286 | 1/1989 | Muscanelli | 206/151 |

FOREIGN PATENT DOCUMENTS

| | | | |
|---|---|---|---|
| 9206016 | 4/1992 | WIPO | 206/147 |

*Primary Examiner*—Jimmy G. Foster
*Attorney, Agent, or Firm*—Plante & Strauss

[57] ABSTRACT

There is disclosed a carrier and storage unit for empty beverage bottles which is a planar member having a plurality of cup-shaped recesses located in an predetermined array across its surface. Each of the cup-shaped recesses has a bottom wall which is sealed about its periphery to the circular wall of the recess. The cup-shaped recesses have a size and configuration adapted to receive and grip the necks of the beverage bottles, capturing the beverage bottles in a secure retention in the carrier and closing the neck of the bottle thereby preventing leakage.

9 Claims, 2 Drawing Sheets

FIGURE 2
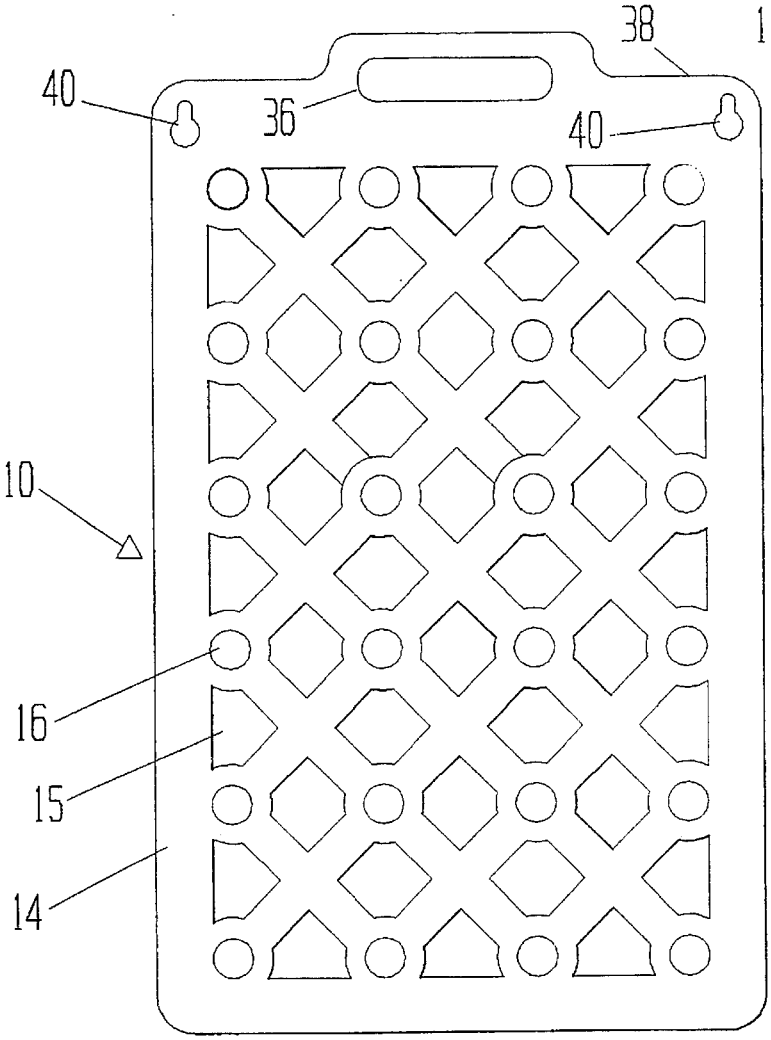
FIGURE 3
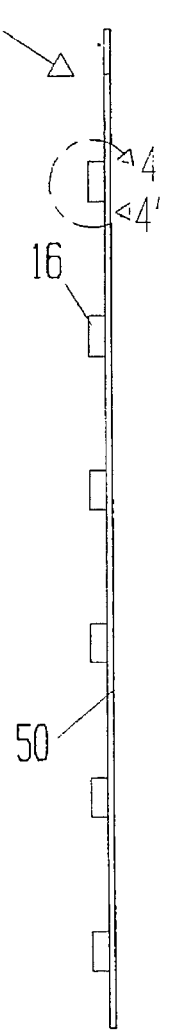
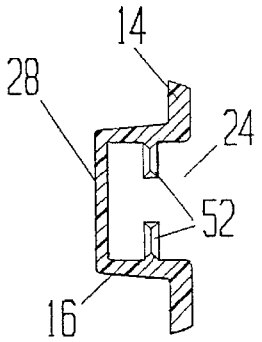
FIGURE 4
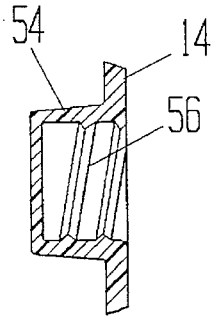
FIGURE 5
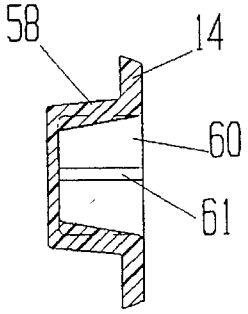
FIGURE 6

RECYCLABLE BOTTLE CARRIER

BACKGROUND OF THE INVENTION

1. Field of Invention

This invention relates to a carrier for bottles and, in particular, to a carrier and storage device for empty plastic beverage bottles.

2. Brief Statement of the Prior Art

The public's increasing awareness of environmental problems created by disposal of plastic containers has popularized recycling of plastic items such as used beverage containers. Recycling efforts are only successful if not inconvenient, and thus there is a need for convenient and sanitary handling and storage of items such as used plastic beverage containers. Some devices have been suggested as carriers for beverage containers in the following patents:

U.S. Pat. No. 4,651,873 discloses a carrier for empty beverage cans which has apertures with tabs that grip the bodies of the empty cans.

U.S. Pat. Nos. 4,236,638 and 4,664,255 discloses carriers for empty beverage cans which have spring prongs that are received in the openings in the tops of empty beverage cans.

U.S. Pat. No. 4,798,286 discloses a strap which has a plurality of apertures interconnected by a continuous slit to receive the necks of empty beverage bottles.

U.S. Pat. No. 4,883,169 discloses a portable bin into which empty beverage bottles and cans can be placed.

U.S. Pat. No. 5,248,035 discloses a case into which empty beverage cans can be stored.

U.S. Pat. No. 5,234,245 discloses a carrying strap which can be threaded through the handles of empty gallon milk cartons.

U.S. Pat. Nos. D252,065, 2,155,884, 4,795,038 and 5,191,975 disclose bottle racks adapted to receive and display bottles.

None of the prior devices prevents any residual contents of the bottles from spilling or leaking from the bottles during storage or handling, which is a necessary precaution to avoid unsightly stains and insect attraction.

OBJECTIVES OF THE INVENTION

It is an objective of this invention to provide a carrier for empty beverage bottles.

It is also an objective to provide a carrier which can be hung on a wall.

It is a still further objective of this invention to provide a carrier to be used to store empty beverage bottles such as the commonly used plastic beverage bottles.

It is further object of this invention to provide an empty beverage bottle carrier and storage unit which will prevent leakage from the bottles.

It is an additional objective of this invention to provide a carrier and storage unit which can be manufactured simply and inexpensively.

It is likewise an objective of this invention to provide a carrier and storage unit for empty beverage bottles which can be reused repeatedly.

Other and related objectives of this invention will be apparent from the following description of the invention.

BRIEF STATEMENT OF THE INVENTION

This invention comprises a carrier and storage unit for empty beverage bottles which is a planar member having a plurality of cup-shaped recesses located in an predetermined array across its surface. Each of the cup-shaped recesses has a bottom wall which is sealed about its periphery to the circular wall of the recess. The cup-shaped recesses have a size and configuration adapted to receive and grip the necks of the beverage bottles, capturing the beverage bottles in a secure retention in the carrier and closing the neck of the bottle thereby preventing leakage.

BRIEF DESCRIPTION OF THE DRAWINGS

The invention will be described with reference to the FIGURES, of which:

FIG. 2 is a front view of another embodiment of the carrier and storage unit of the invention;

FIG. 3 is a side elevational view of the carrier and storage unit of FIG. 2;

FIG. 4 is an enlarged sectional view of the area within line 4—4' of FIG. 3;

FIG. 5 is a sectional view of an alternative cup-shaped recess for the unit of the invention;

FIG. 6 is a sectional view of another alternative cup-shaped recess for the unit.

DESCRIPTION OF THE PREFERRED EMBODIMENT

Figure 1:
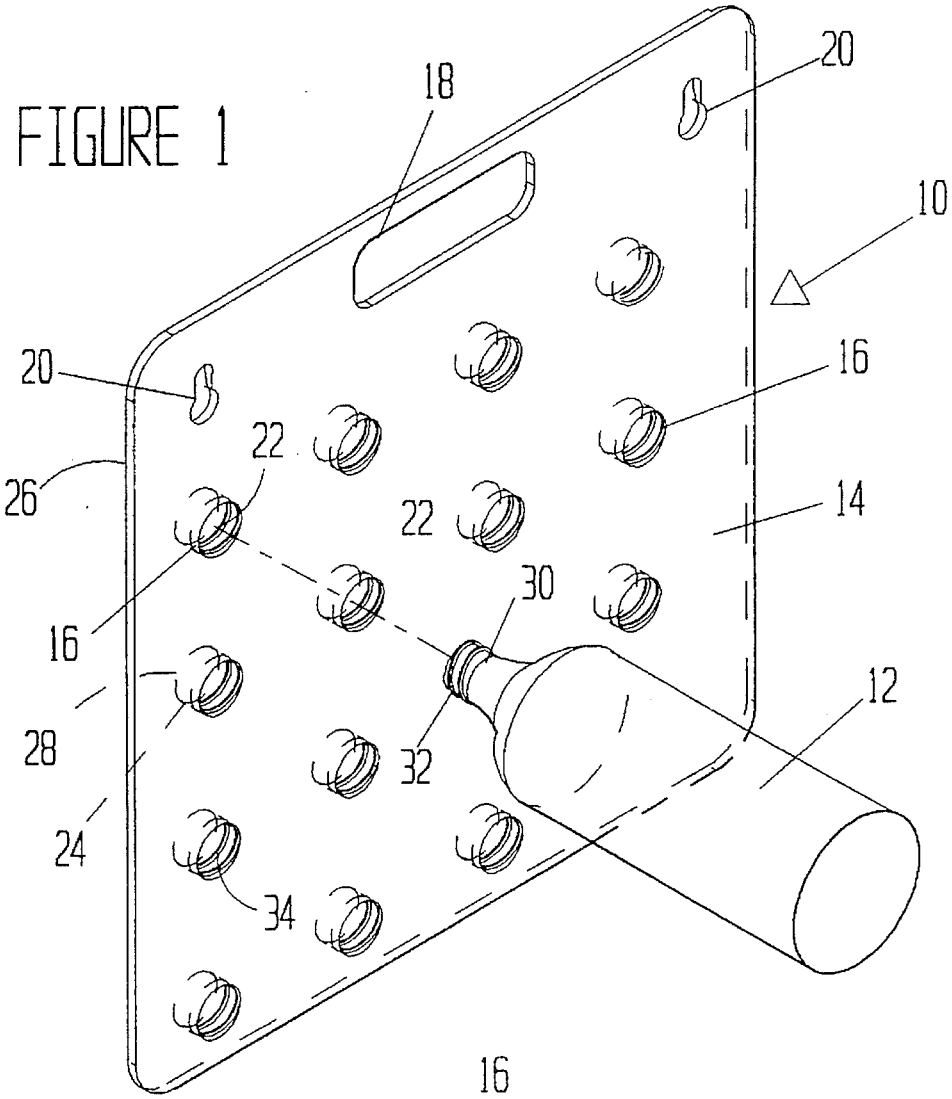
FIG. 1 is a perspective view of the carrier and storage unit of the invention with an empty beverage bottle positioned to be inserted in a cup-shaped recess of the unit.

Referring now to FIG. 1, the invention is a carrier and storage unit 10 for empty beverage bottles 12. The unit 10 is essentially a flat plate 14 having a plurality of cup-shaped recesses 16 and a suitable hand grip 18 for carrying of the unit. The unit can also have one or more apertures 20 in its opposite upper corners such as the illustrated key slots which are suitable for hanging the unit on a wall for convenient storage. The hand grip 18 can be of various designs; the illustration of FIG. 1 shows a rectangular aperture through the plate 14, of sufficient span to receive the user's hand.

Disposed across the face of the plate 14 are a plurality of cup-shaped recesses 16 which are located in a generally rectangular grid array, spaced apart sufficiently to provide clearance for insertion of empty beverage bottles 12 in adjacent cup-shaped recesses 16. Each of the cup-shaped recesses 16 has an open mouth 22 lying in the plane of the plate 14, and has a generally cylindrical side wall 24 that extends beyond the rear surface 26 of the plate 14, and engages a bottom wall 28 which is sealed completely about its periphery to the side wall.

The internal side wall 24 of the recess 16 has grips which engage the neck 30 of the bottles 12. The carrier is useful for storage and handling of conventional plastic beverage bottles 12 such as pint, quart, half-gallon, one liter, two liter, and the like, beverage bottles which are molded of plastics. A typically bottle has a reduced diameter neck 30 which has external threads in the form of a helical groove 32 for fastening of an internally threaded closure. In the illustrated embodiment, each of the recesses 16 has a helical bead 34 on the internal side wall 24 which threadably engages the helical groove 32 on the bottle neck 30.

The carrying and storage unit of the invention is formed of inexpensive material and, preferably, is thermoformed or injection molded of an inexpensive plastic such as low density polyethylene. Many different thermoplastics can be used for fabrication of the unit, however, low density polyethylene is entirely suitable and as it is the least expensive, it is the material of choice.

The carrier and storage unit 10 of the invention is well suited for injection molding, as the cup-shaped recesses 16 can be readily molded into the unit 10 using the molding technology such as the various split molds and runners developed for injection molding of plastic bottle caps.

Referring now to FIG. 2, there is a slightly modified alternative of the unit 10 of the invention shown in frontal view. As there illustrated, the carrier and storage unit 10 has a handle 36 which projects from its upper edge 38. This construction minimizes the amount of material required for the fabrication while providing an attractive and very serviceable handle. Also, the plate 14 is provided with a plurality of apertures 15 which reduce the weight and cost of the unit, without comprising its strength or functioning.

As with the previously described embodiment, this unit also can be provided with apertures 40 in its opposite top corners to receive hooks for securing the unit 10 against a wall in a garage or closet, etc.

FIG. 3 is an elevational side view of the unit 10, shown in FIG. 2 and the cup-shaped recesses 16 can be seen to project beyond the rear surface 50 of the unit 10, thereby providing adequate depth to retain the necks of the empty beverage bottles.

Referring now to FIG. 4, the cup-shaped recess 16 is shown in sectional view to include a generally circular side wall 24 with an integral bottom wall 28 thereby providing an entirely closed recess in the plate 14 of the unit. The diameter of the circular side wall is sufficient to permit insertion of the neck of the empty beverage bottle and is provides with retention means in the form of one or more annular beads 52 which are generally triangular in cross sectional shape and which extend about the inner periphery of the side wall. The inclined side walls of the beads provide for ease of insertion and removal of the bottle necks, and for ease in ejecting the molded units from the mold cavities used in manufacture, e.g., cavities of injection molds. Although a triangular cross section is preferred for this purpose, other shapes with inclined or arcuate sidewalls can also be used. The beads can be discontinuous as illustrated or one or more continuous and spaced-apart beads can be used. The beads are adapted to interlock into the helical groove of the bottle neck which, as previously mentioned, provide screw threads for threaded closures. As the material for the carrier and storage unit is resilient and slightly elastic, and the bottle neck is deformable, the beads 52 will snap into the helical groove on the bottle neck when the bottle neck is forcefully inserted into the cup-shaped recess 16.

Alternative retention means can be provided, and FIGURE illustrates a suitable cup-shaped recess 54 in which the annular bead on the inside periphery of the sidewall of the recess is a continuous helical bead 56 which mates with the helical screw groove of the bottle neck permitting the bottle to be inserted by threading the neck into the cups-shaped recess 54.

The construction of the unit of the invention can be simplified further by the use of the cup-shaped recesses 58 shown in FIG. 6. In that illustration, each cup-shaped recess 58 has one or more tapered ribs 61, which are disposed in the illustrated embodiment at 90 degree angular increments. As previously mentioned, the plastic material used for the unit is slightly resilient and deformable so that the bottle neck can be forced into the recess 58, compressing against the tapered ribs 61 in a snug friction fit, thereby removably receiving the bottle. This construction eliminates the use of runners in the molds for forming the cup-shaped recesses, and reduces the cost and maintenance of the molding equipment.

Figure 7:
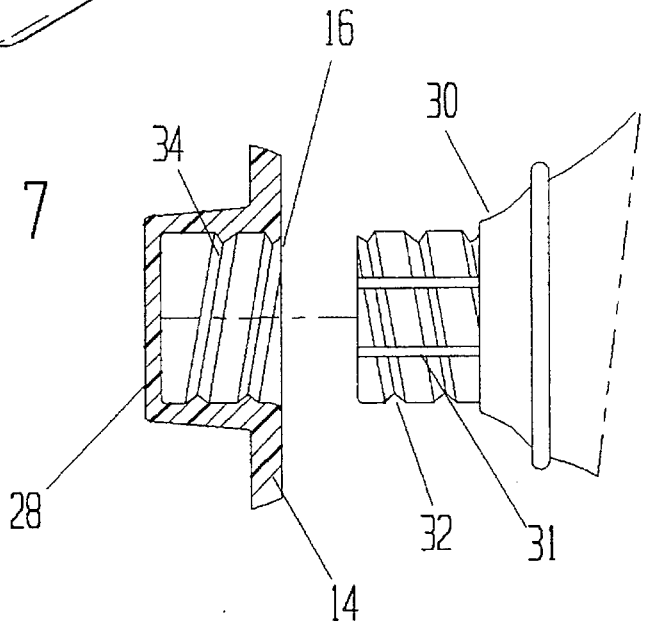
FIG. 7 is a sectional view of a threaded cup-shaped recess and the neck of a bottle.

As shown in FIG. 7, the exterior surface of the bottle neck 30 has a conventional helical groove 32 which receives caps with mating internal threads. The cup recess shown in FIG. 5 is illustrated beside the bottle neck 30 with its internal threads 34 which engage in the helical groove 32 of the bottle neck. The bottle neck also has a plurality of axial grooves 31 which intersect and interrupt the helical groove 32, as conventional in molded plastic bottles.

The invention provides a very simple and highly efficient unit for storing and carrying of empty plastic beverage bottles. Since the cup-shaped recesses are entirely closed and sealed, the bottles can be inserted and stored without the threat of leaking or draining of any residual contents of the bottles. This eliminates an objectionable problem of leaking of the contents of the bottles, which can stain surfaces and provide attractants for pests and insects. The unit provides for facile insertion of the empty beverage bottles and secure retention of the bottles permitting its use as a carrier to transport the bottles to a recycling center. Since the bottles can be inserted and extracted repeatedly without damage to the carrier unit, the unit can be reused for extended periods of time. Since the unit can be hung on a wall, use of limited floor or shelf space is avoided. All of these factors promote the recycling of the beverage bottles by eliminating various objections and problems which are encountered during storage and transportation of the empty beverage bottles to a recycling center.

Preferably the unit is formed of relatively inexpensive plastics, such as low density polyethylene, which are non-absorbent and thus can be easily cleaned with soap and water.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. The combination of a hand-held holder and at least one empty, uncapped bottle having, at its upper extremity, a cylindrical neck of an axial length no greater than the height of its bottlecap and a reduced diameter from that of its body and bearing an external groove for retention of a bottlecap, which comprises:

a. a one-piece holder having a planar body formed of a single, rigid, flat sheet extending the width and length of said body;

b. a plurality of apertures disposed about an apertured area entirely within the periphery of said flat sheet at spacings substantially equal to the diameters of said bottles;

c. a plurality of integral bottleneck receptacles, one each with each of said apertures, each of said receptacles having a diameter of said bottle neck, with a substantially cylindrical side wall having an axial length no greater than the axial length of said cylindrical neck and a bottom wall, thereby forming a generally cup-shaped receptacle closed about its bottom wall and open at said aperture; and d. at least one rib projecting from the interior of said sidewall of each of said receptacles to engage said groove on said bottle necks, whereby said bottles can be secured in orthoganol positions to said planar body;

e. a carrier support located outside of said apertured area, and adjacent the upper edge of said flat sheet, whereby said body is disposed in a vertical plane; and d. at least one empty and cap-less bottle with its cylindrical neck received within one of said receptacles and secured therein by said rib and projecting orthogonally to the vertical plane of said body.

2. The holder of claim 1 wherein said rib is a helical rib to provide screw engagement with the groove of said bottle.

3. The holder of claim 1 wherein said rib is a discontinuous rib which can snap into engagement with the groove of said bottle.

4. The holder of claim 1 wherein said recess has tapered internal, axially aligned ribs to receive the neck of an empty beverage bottle in a friction fit.

5. The holder of claim 1 wherein said support is a slot to provide a hand grip disposed along the upper edge of said planar body.

6. The holder of claim 1 formed of thermoplastic by injection molding, with integral recesses which are one-piece with said body.

7. The holder of claim 1 including apertures in the opposite top corners of said plate to receive hooks for supporting said unit against a wall.

8. The holder of claim 1 wherein said support comprises apertures in the opposite top corners of said planar body to receive hooks for supporting said holder against a wall.

9. The holder of claim 1 wherein said body is foraminous with a plurality of through openings disposed beside said cup recesses.

* * * * *